United States Patent [19]

Greene

[11] 4,121,831

[45] Oct. 24, 1978

[54] GEOMETRICAL CONSTRUCTIONS

[76] Inventor: E. Colton Greene, c/o Prof. John C. Greene, 10 Thompson Rd., Storrs, Conn. 06268

[21] Appl. No.: 796,265

[22] Filed: May 12, 1977

[51] Int. Cl.[2] ..... A63F 9/12

[52] U.S. Cl. ..... 273/160; 46/25

[58] Field of Search ..... 273/156, 157 R, 160; 35/18 A, 72; 46/25

[56] References Cited

U.S. PATENT DOCUMENTS

| | | | |
|---|---|---|---|
| 2,839,841 | 6/1958 | Berry | 35/18 A |
| 3,461,574 | 8/1969 | Larsen et al. | 273/156 X |
| 3,885,794 | 5/1975 | Coffin | 273/160 |

FOREIGN PATENT DOCUMENTS

| | | | |
|---|---|---|---|
| 245,402 | 7/1947 | Switzerland | 273/160 |

*Primary Examiner*—Anton O. Oechsle

*Attorney, Agent, or Firm*—Leitner, Palan, Martin & Bernstein

[57] ABSTRACT

A construction in the shape of an octahedron assembles from a plurality of three dimensional U-shaped or V-shaped constructional elements or "pieces." Six identical U-shaped or V-shaped pieces form a single octahedron. Two V-shaped pieces may also form a smaller octahedron. The U-shaped and V-shaped pieces, each having trapezoidal surfaces, can also be used to assemble a variety of non-octahedral constructions. Preferably, the triangular faces of six-piece octahedral constructions are each composed of three trapezoidal surfaces.

15 Claims, 10 Drawing Figures

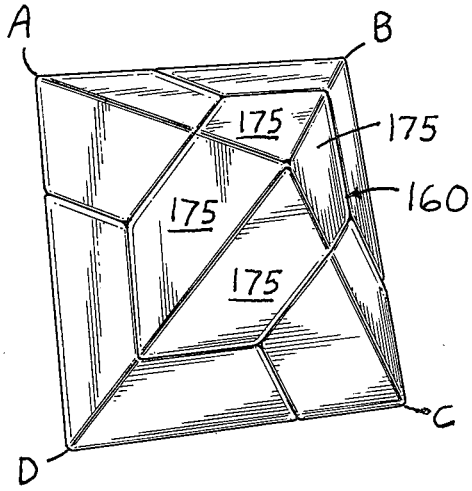
FIG.1
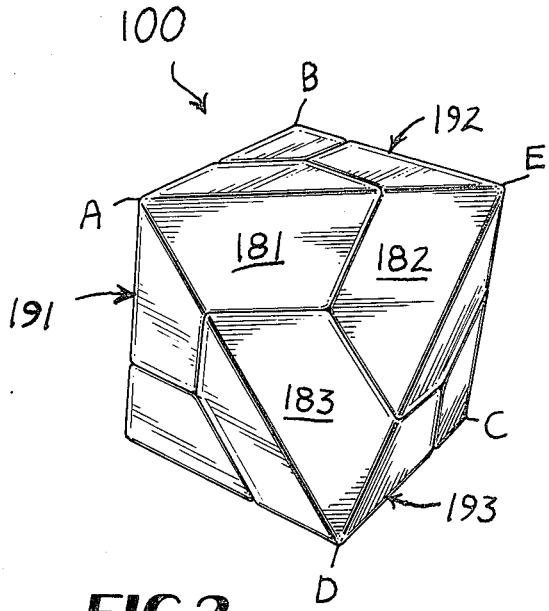
FIG.2
FIG.5
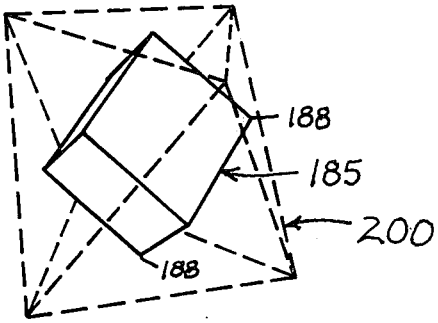
FIG.9
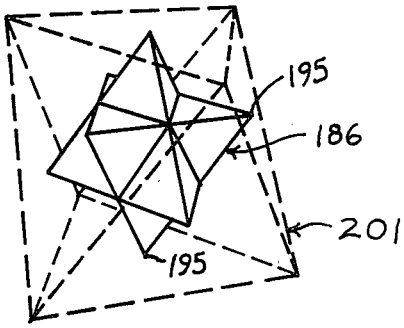
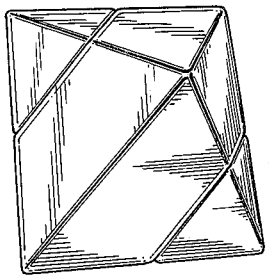
FIG.10

FIG.3
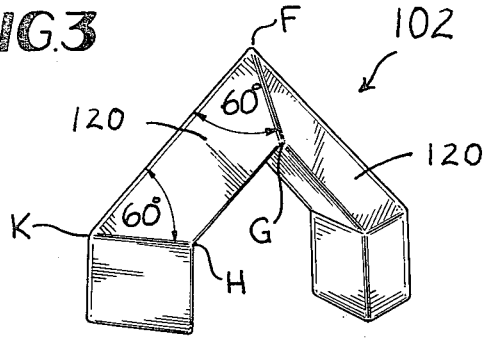
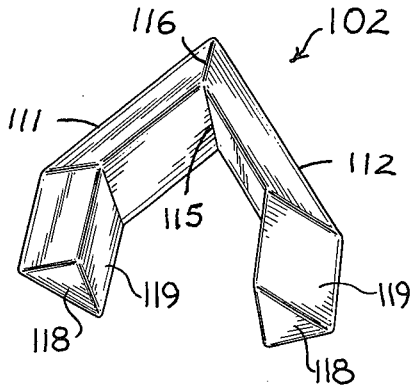
FIG.4
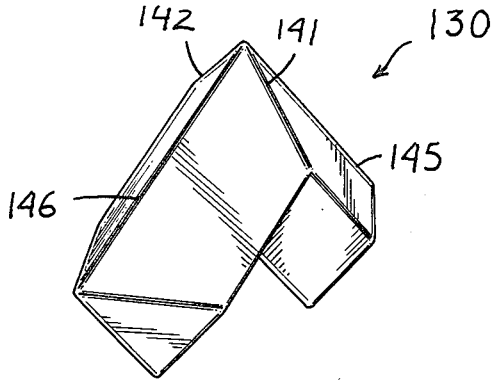
FIG.7
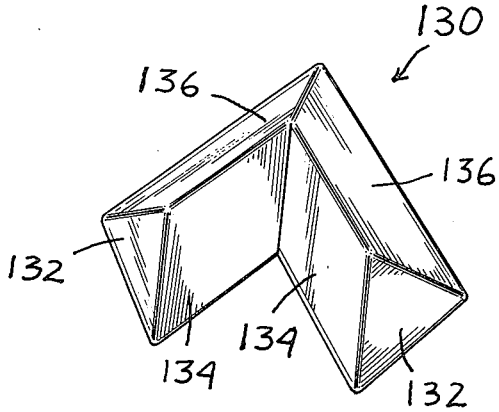
FIG.8
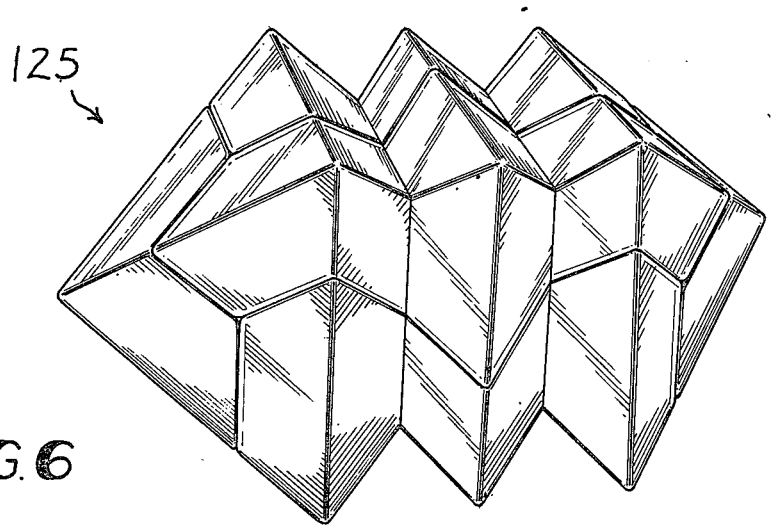
FIG.6

GEOMETRICAL CONSTRUCTIONS

SUMMARY OF THE INVENTION

The invention relates to assembly puzzles and other geometrical constructions which assemble from a plurality of three dimensional constructional elements or "pieces."

The invention consists of certain novel details of construction and combinations of parts which will become apparent as the description proceeds. One preferred embodiment of the invention is an assembly puzzle comprising six identical U-shaped pieces which form an octahedral construction having an internal void in the shape of a cube. A second preferred embodiment of the invention is an assembly puzzle comprising six identical V-shaped pieces which form either three small octahedral constructions, each assembled from two pieces, or one large octahedral construction having an internal void in the shape of a stella octangula.

The individual U-shaped and V-shaped pieces mentioned above each comprise a plurality of polygonal surfaces including four trapezoidal surfaces which have the same relative angular dispositions to each other as the four triangular faces which meet at one vertex of a regular octahedron. Three of these trapezoidal surfaces form each of the triangular faces of the above mentioned six-piece octahedral constructions. The above mentioned U-shaped and V-shaped pieces (and permutations of them) can also be used to assemble a variety of non-octahedral constructions.

Each of the assemblages illustrated in the accompanying drawings can be assembled from a plurality of identical pieces. Thus, manufacture of plastic pieces for the illustrated assemblages requires only a single type of mold and is therefore economical and efficient.

Accordingly, a primary object of the invention is to provide an interesting and challenging puzzle.

Another object of the invention is to provide a puzzle that can be economically mass produced.

A further object of the invention is to provide an attractive and versatile modular constructional element.

DESCRIPTION OF THE DRAWINGS

In the drawings:

FIGS. 1 and 2 are perspective views of a six-piece octahedral construction embodying the invention;

FIGS. 3 and 4 are perspective views of the constructional element identified herein as a U-piece;

FIG. 5 is a perspective view of the internal void within the construction of FIGS. 1 and 2;

FIG. 6 is a perspective view of an assemblage of U-pieces;

FIGS. 7 and 8 are perspective views of the constructional element identified herein as a V-piece;

FIG. 9 is a perspective view of the internal void within the octahedral construction assembled from six V-pieces; and FIG. 10 is a perspective view of an octahedral construction assembled from two V-pieces.

DESCRIPTION OF THE PREFERRED EMBODIMENTS

Turning now to the drawings, FIGS. 1 and 2 are perspective views of an octahedral construction 100 embodying the invention. Construction 100 asembles from six identical interlocking U-shaped pieces which are each identical to piece 102, shown from two different perspectives in FIGS. 3 and 4. Pieces having the precise geometry of piece 102 will be called "U-pieces".

Each U-piece is bilaterally symmetrical with respect to each of two mutually perpendicular planes. Piece 102 is bilaterally symmetrical with respect to both the plane defined by edges 111 and 112 and the plane defined by edges 115 and 116. Fourteen polygons form the surface of each U-piece including two triangles 118, eight rectangles 119, and four trapezoids 120. Each of the trapezoids 120 have three sides of equal length and two interior angles of 60°. In FIG. 3, for example, FG, GH, and HK are three equal length edges of trapezoidal surface FGHK which has two interior angles of 60° as shown. The four trapezoidal surfaces of each U-piece have the same relative angular dispositions to each other as the four triangular faces which meet at one vertex of a regular octahedron. This fact is evident in FIG. 1, wherein the four trapezoidal surfaces 175 of U-piece 160 form a corner of construction 100. As is apparent in FIGS. 3 and 4, the four prisms which constitute a U-piece each have a triangular cross-section.

Each of the triangular faces of construction 100 is formed from three trapezoidal surfaces, each belonging to a separate U-piece. In FIG. 2, for example, triangular face ADE is formed from trapezoidal surface 181 of U-piece 191, trapezoidal surface 182 of U-piece 192, and trapezoidal surface 183 of U-piece 193.

Construction 100 is bilaterally symmetrical (both internally and externally) with respect to three mutually perpendicular planes, and four vertices of construction 100 lie in each of these planes of bilateral symmetry. For example, vertices A, B, C, and D of construction 100 lie in one plane of bilateral symmetry. Construction 100 is entirely symmetrical in the sense that each of its component pieces bears exactly the same relationship to the whole construction as every other piece.

Construction 100 has an internal void in the shape of a cube. In FIG. 5, this cubic void 185 is shown in solid lines, and the outline 200 of construction 100 is shown in broken lines. The vertices 188 of the cubic void 185 coincide with the midpoints of the faces of construction 100.

Construction 100 can be used as a "take-apart and put-together" puzzle, and it also makes an attractive conversation piece. Since its interior is hollow and accessible, construction 100 can also be used as a secret stash box.

Aside from construction 100, U-pieces can be used to assemble more elaborate constructions. For example, construction 125 shown in FIG. 6 can be assembled from fourteen interlocking U-pieces. Construction 125 exemplifies linear "chaining" of octahedra, a repetitive process that can be extended to make longer chains. Two dimensional and three dimensional chaining of U-pieces is also possible, and of course, U-pieces can be combined in various asymmetrical ways. In short, U-pieces are unique, versatile modular constructional elements.

FIGS. 7 and 8 depict a V-shaped piece 130 that is bilaterally symmetrical with respect to each of two mutually perpendicular planes. Edges 141 and 142 lie in one plane of bilateral symmetry, and edges 145 and 146 lie in the other plane of bilateral symmetry. Pieces having the precise geometry of piece 130 will be called "V-pieces."

The surface of one V-piece consists of twelve polygons which include four equilateral triangles 132, four rhombuses 134, and four trapezoids 136, each trapezoid 136 having three sides of equal length and two interior angles of 60°. The four trapezoidal surfaces 136 of one V-piece have the same relative angular dispositions to each other as the four triangular faces which meet at one vertex of a regular octahedron. Note that U-pieces and V-pieces have exactly the same configuration of trapezoidal surfaces. As is apparent in FIGS. 7 and 8, in the region of their midpoints both "legs" of a V-piece have a cross-section in the shape of a rhombus.

An octahedral construction having the same outward appearance as construction 100 can be assembled from six V-pieces. An octahedral construction assembled from six V-pieces is bilaterally symmetrical (both internally and externally) with respect to each of three mutually perpendicular planes, and each V-piece in this octahedral construction bears the same relationship to the whole construction as every other V-piece.

An octahedral construction assembled from six V-pieces has an internal void in the shape of a stella octangula (a stella octangula is a geometric solid formed by two juxtaposed tetrahedra, each edge of one tetrahedron bisecting an edge of the other tetrahedron and vice versa). In reference to FIG. 9, the outline 201 of an octahedral construction assembled from six V-pieces is shown in broken lines, and the void 186 (having the shape of a stella octangula) within the outlined construction is shown in solid lines. The midpoints of the faces of the octahedral construction outlined in FIG. 9 coincide with the trihedral vertices 195 of the internal void 186.

An octahedral construction can also be assembled from only two V-pieces as depicted in FIG. 10. Accordingly, six V-pieces can be used to assemble either one large octahedral construction (appearing as shown in FIGS. 1 and 2), or they can be used to assemble three small octahedral constructions (each appearing as shown in FIG. 10). Thus, six V-pieces can function as an assembly puzzle, the object being to convert three small octahedral constructions, each assembled from two pieces, into one large octahedral construction. A desirable feature of this puzzle is that, unlike "take-apart and put-together" puzzles, the solution need not be witnessed before the puzzle is attempted. Like U-pieces, V-pieces are modular constructional elements that can be used to assemble a variety of non-octahedral constructions.

Construction 100 can be embellished by decorating the trapezoidal surfaces of its component U-pieces. Decorating the trapezoidal surfaces with repetitive geometric patterns sculpted in shallow relief is particularly attractive. Of course, this technique can also be applied to V-pieces and other constructional elements.

Constructional elements comprising truncations, combinations, or other permutations of U-pieces and V-pieces are also useful in building geometrical assemblages, particularly assemblages having shapes that are related to the octahedron such as the cuboctahedron and the truncated octahedron. It should be noted that the cuboctahedron and the truncated octahedron each have fourteen faces including eight faces which collectively have the same relative angular dispositions to each other as the faces of a regular octahedron. Typically, useful permutations of U-pieces and V-pieces are non-convex and display four substantially planar surfaces (which are not necessarily contiguous) having the same relative angular dispositions to each other as the four triangular faces which meet at one vertex of a regular octahedron. By definition, a three dimensional solid is non-convex if a straight line can be drawn between two of its points which is not entirely contained within that solid.

It is to be understood that changes may be made in the construction and arrangement of parts disclosed herein without departing from the spirit of the invention as claimed.

What is claimed is:

1. A construction comprising a plurality of interrelated non-convex three dimensional pieces, each of said pieces being substantially U-shaped or V-shaped, said construction having substantially the shape of an octahedron.

2. A puzzle comprising six three dimensional V-shaped pieces, the shapes of said six pieces being such that they can be assembled to form three constructions, each of said constructions being assembled from two of said six pieces and each of said constructions having substantially the shape of an octahedron, and said six pieces can also be assembled to form a single construction having substantially the shape of an octahedron.

3. A construction comprising six interrelated three dimensional V-shaped pieces, said construction having substantially the shape of an octahedron and said construction having an internal void having substantially the shape of a stella octangula, each face of said construction including three distinct trapezoidal surfaces.

4. A construction comprising a plurality of interrelated three dimensional U-shaped pieces, said construction having substantially the shape of an octahedron and said construction having an internal void having substantially the shape of a cube, each face of said construction including three distinct trapezoidal surfaces.

5. A construction comprising a plurality of interrelated non-convex three dimensional pieces, said construction having substantially the shape of an octahedron, at least one face of said construction including three distinct trapezoidal surfaces.

6. A unitary three dimensional U-shaped or V-shaped constructional element comprising a plurality of substantially planar surfaces which include four surfaces having the same relative angular dispositions to each other as the faces which meet at one vertex of a regular octahedron.

7. A three dimensional U-shaped or V-shaped constructional element comprising a plurality of substantially planar surfaces including four surfaces having the same relative angular dispositions to each other as the faces which meet at one vertex of a regular octahedron, each of said four surfaces having substantially the shape of a trapezoid having three sides of equal length and two interior angles of 60°.

8. A three dimensional V-shaped constructional element comprising twelve substantially planar surfaces including four triangular surfaces, four rhombic surfaces, and four surfaces having the shape of a trapezoid having three sides of equal length and two interior angles of 60°, said four trapezoidal surfaces having the same relative angular dispositions to each other as the faces which meet at one vertex of a regular octahedron.

9. A three dimensional U-shaped constructional element comprising a plurality of substantially planar surfaces including two triangular surfaces, eight rectangular surfaces, and four surfaces having substantially the shape of a trapezoid having three sides of equal length and two interior angles of 60°, said four trapezoidal surfaces having the same relative angular dispositions to each other as the faces which meet at one vertex of a regular octahedron.

10. A three dimensional V-shaped constructional element comprising a plurality of substantially planar surfaces, the shape of said element being such that two of said elements can be assembled to form a construction having substantially the shape of an octahedron, and six of said elements can be assembled to form another construction having substantially the shape of an octahedron.

11. A construction comprising a plurality of interrelated U-shaped or V-shaped three dimensional pieces, each of said pieces having a plurality of substantially planar surfaces including four surfaces having the same relative angular dispositions to each other as the faces which meet at one vertex of a regular octahedron, said construction having a plurality of substantially planar surfaces including eight surfaces having the same relative angular dispositions to each other as the eight faces of a regular octahedron.

12. A construction comprising a plurality of U-shaped or V-shaped three dimensional pieces, each of said pieces including four substantially planar surfaces which have the same relative angular dispositions to each other as the faces which meet at one vertex of a regular octahedron.

13. The construction of claim 12 in which one of said pieces includes a region of substantially uniform cross-section within which said cross-section has the shape of a triangle.

14. The construction of claim 12 in which one of said pieces includes a region of substantially uniform cross-section within which said cross-section has the shape of a rhombus.

15. The construction of claim 12 in which one of said pieces includes four substantially planar surfaces which each have the shape of a rhombus.

* * * * *